US011464387B2

(12) United States Patent
Saluccio

(10) Patent No.: US 11,464,387 B2
(45) Date of Patent: Oct. 11, 2022

(54) COMBINATION OF A DUST PAN AND A BROOM

(71) Applicant: Raymond Saluccio, Colonia, NJ (US)

(72) Inventor: Raymond Saluccio, Colonia, NJ (US)

( * ) Notice: Subject to any disclaimer, the term of this patent is extended or adjusted under 35 U.S.C. 154(b) by 202 days.

(21) Appl. No.: 16/710,837

(22) Filed: Dec. 11, 2019

(65) Prior Publication Data

US 2021/0177232 A1 Jun. 17, 2021

(51) Int. Cl.
*A47L 13/52* (2006.01)
*A46B 15/00* (2006.01)

(52) U.S. Cl.
CPC ..... *A47L 13/52* (2013.01); *A46B 15/0055* (2013.01); *A46B 2200/302* (2013.01)

(58) Field of Classification Search
CPC ..... A47L 13/52; E01H 2001/122; E01H 2001/1226; E01H 2001/1293; A46B 2200/302
USPC ..... 15/257.1, 257.2, 257.7
See application file for complete search history.

(56) References Cited

U.S. PATENT DOCUMENTS 129,935 A * 7/1872 Conger ..... A47L 13/52 15/257.2
419,115 A * 1/1890 Ennis ..... A47L 13/52 15/257.2
677,950 A * 7/1901 Cutter ..... A47L 13/52 15/257.4
783,657 A * 2/1905 Walter ..... A47L 13/52 15/257.2
3,170,183 A * 2/1965 Leatherman ..... A47L 13/52 15/257.1
4,048,692 A * 9/1977 Coffey ..... A47L 13/52 15/257.2
5,379,481 A * 1/1995 DeMars ..... A47L 13/52 15/257.2
5,826,297 A * 10/1998 Footer ..... A47L 13/52 15/257.5

FOREIGN PATENT DOCUMENTS

DE 2410806 A1 * 9/1975 ..... A47L 13/52

OTHER PUBLICATIONS

English translation of DE 2410806 A1, Schlemminger, Sep. 1975. (Year: 1975).*

* cited by examiner

*Primary Examiner* — Laura C Guidotti
(74) *Attorney, Agent, or Firm* — Ezra Sutton; Anthony Morano

(57) ABSTRACT

The combination of a dust pan and a broom for cleaning surfaces without the need for a person to bend during use, including a dust pan having a receptacle for receiving and collecting debris, and a lifting strap extends over the receptacle. A broom is also provided having bristles and an upper section having a hook mounted thereon. In use, the hook is used to engage the strap to lift the dust pan having debris in it without the person having to bend their back or knees to lift up and lower the dust pan during use. The dust pan can be square or round or any other shape.

8 Claims, 6 Drawing Sheets

COMBINATION OF A DUST PAN AND A BROOM

FIELD OF THE INVENTION

The combination of a dust pan and broom is provided for cleaning surfaces without the need for the person to bend their back or knees to pick up the dust pan.

BACKGROUND OF THE INVENTION

Typically, when a dust pan is being used for cleaning, the person using the dust pan has to bend their back and knees to lift the dust pan to dispose of the debris during use. The present invention provides a construction that prevents the person from having to bend their back or knees to lift up the dust pan from the floor, or to lower it to the floor.

This invention provides the ability to position the dust pan on the floor without bending over, which results in saving time. As described, there is a reduction in motion to complete the task making this process more efficient to both lift up and lower the dust pan during use, without the need of placing stress on the user's knees and back area. Also, this one step process saves stress on both the back and the knees, as these two body parts are needed to complete the conventional process of sweeping up and collecting debris from all indoor and outdoor surfaces.

DESCRIPTION OF THE PRIOR ART

Published patent application no. 2009/0223007, published on Sep. 10, 2009, discloses a combination of a dust pan 50 and a broom 12, wherein the broom has two hanging holes 24 and 26, one near the bottom and the other near the top of the broom handle. The hanging hole 24 is adopted to receive a male peg 70 for storing and hanging the dust pan on the broom handle. Similarly, the hanging hole 26 is adopted to receive a male peg for storing and hanging the broom handle.

This prior art does not teach or disclose the present invention of having a hook on the broom for lifting and lowering the dust pan from the floor without bending the user's knees or back area.

OBJECTS OF THE INVENTION

It is an object of the present invention to provide a dust pan and a broom for cleaning surfaces without the need for the person to bend their back to pick up the dust pan.

Another object of the present invention is to provide a construction that prevents the person from having to bend their back to lift up the dust pan.

Another object of the present invention is to provide a combination dust pan and a broom that is simple and easy to use.

Another object of the present invention is to provide a combination dust pan and a broom that is economical.

SUMMARY OF THE INVENTION

The combination of a dust pan and a broom for cleaning surfaces without the need for a person to bend during use, including a dust pan having a receptacle for receiving and collecting debris, and a lifting strap extends over the receptacle. A broom is also provided having bristles and an upper section having a hook mounted thereon. In use, the hook is used to engage the strap to lift the dust pan having debris in it without the person having to bend their back to lift up the dust pan. The dust pan can be square or round or any other shape.

DETAILED DESCRIPTION OF THE PREFERRED EMBODIMENT

Figure 1:
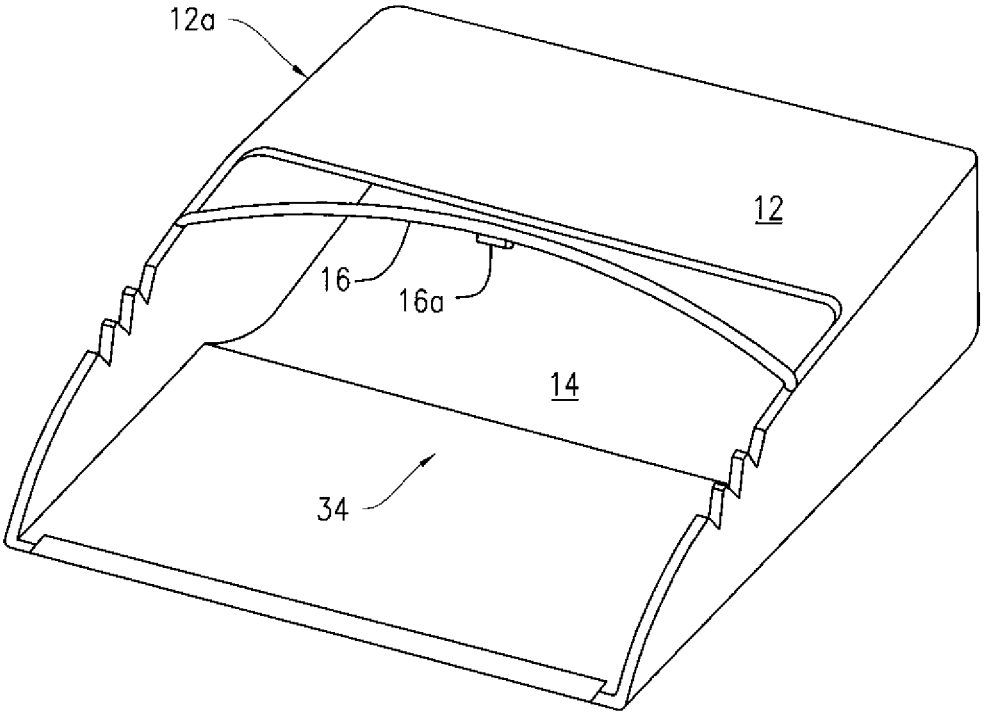
FIG. 1 is a perspective view of the combination of a broom and a dust pan.
Figure 2:
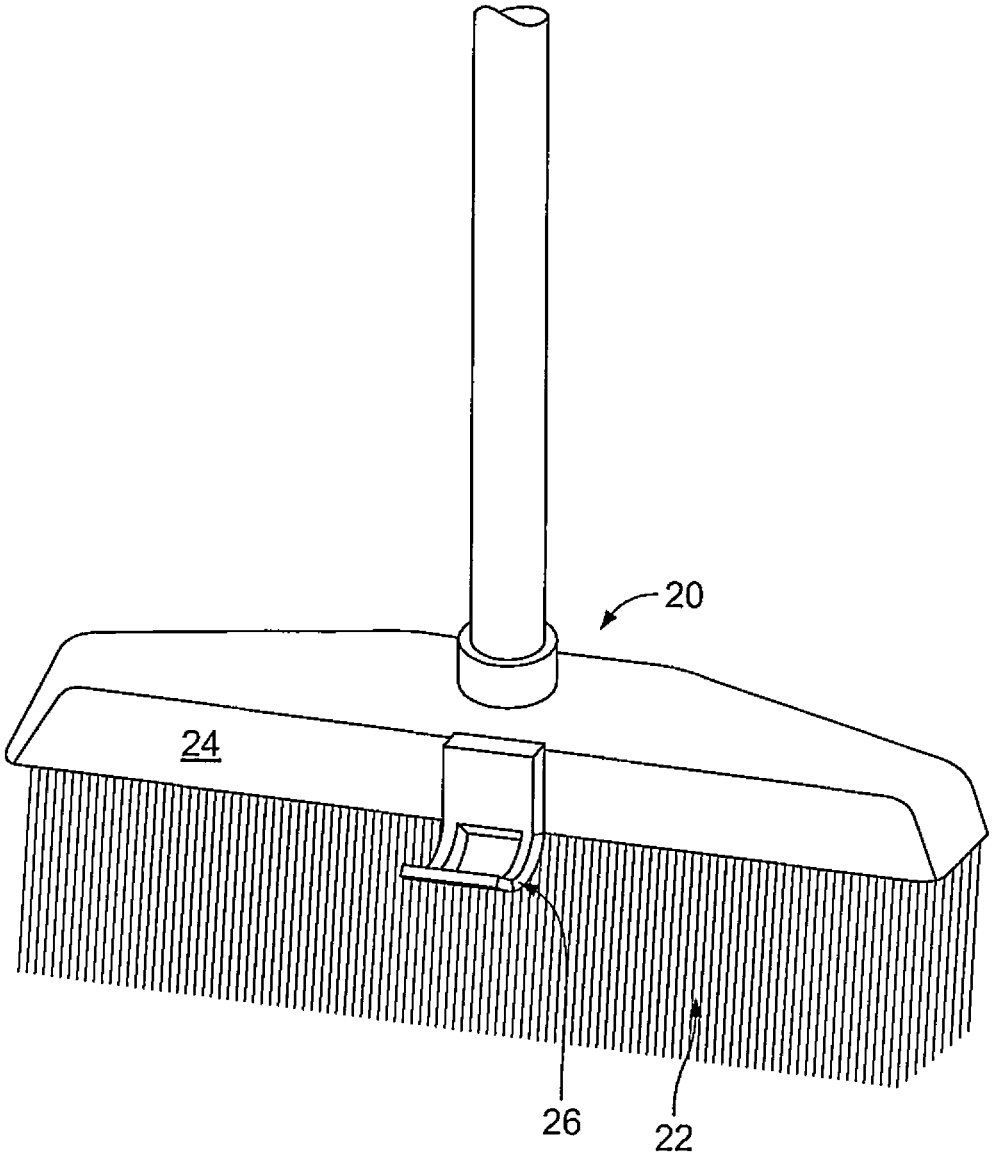
FIG. 2 is a detailed view of the dust pan.

The combination 10 of a dust pan 12 and a broom 20 for cleaning surfaces without the need for a person to bend during use, including the dust pan 12 having a receptacle 14 for receiving and collecting debris, and having a lifting strap 16, which extends over the receptacle 14. The broom 20 has bristles 22 and an upper section 24 having a hook 26 mounted thereon.

The upper edge of receptacle 14 has teeth 18 for cleaning the bristles 22 of broom 20. In addition, the dust pan 12 has an upper surface 12*a* to allowing the user to place their foot on top of the dust pan 12 to hold it down during use.

Further, dust pan 12 has a bottom surface 30 that is an anti-slip surface having gripping material applied to the bottom of the dust pan 12. In this manner, the user can fill up the dust pan 12 without the need of stepping on the upper surface 12*a* of dust pan 12 without using the foot to keep it in place, since the anti-slip gripping material 32 is applied to the bottom surface 30 of dust pan 12 in order to keep the dust pan 12 in place on all types of surfaces. In addition, use of the gripping material 32 will open up the back of the dust pan 12 to provide a larger area 34 in the receptacle 14 to store and collect more debris in the rear of dust pan 12.

In use, the hook 26 is used to engage the notch 16*a* of the strap 16 to lift the dust pan 12 having debris in it without the person having to bend their back to lift up the dust pan 12.

Figure 5:
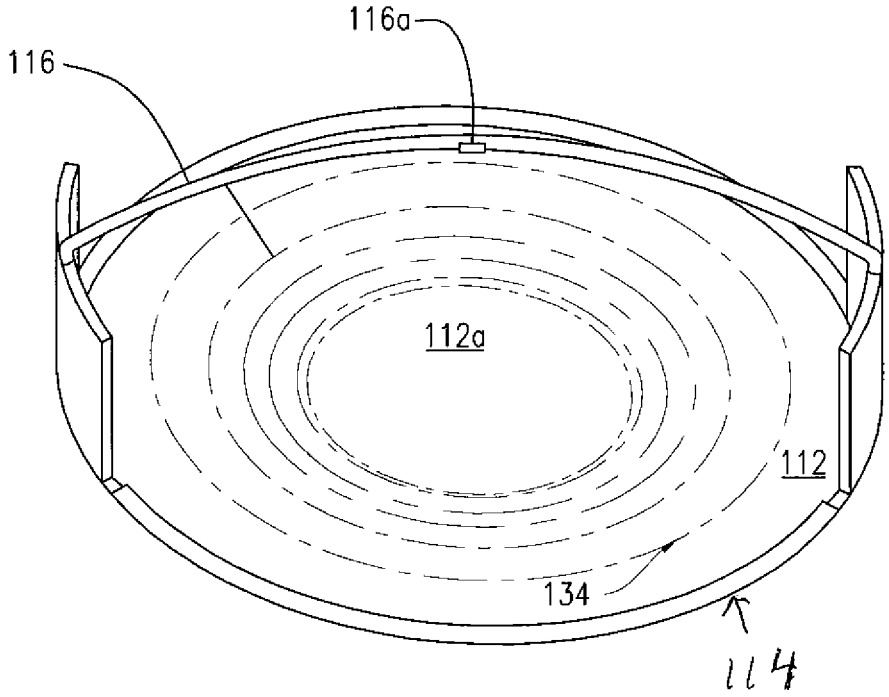
FIG. 5 is a perspective view of the round dust pan.

In a second embodiment shown in FIG. 5, dust pan 112 has a circular shape and has a strap 116 extending over the top of the dust pan to lift it. The round dust pan 112 is provided with an enlarged area 134 and can have a cover 125, or as shown, it can be open in both the front 121 and back 122 for easy access. Also, the bottom surface 112 has a depression 112*a* in the receptacle 114 to hold the debris collected without spilling it when the dust pan is lifted or lowered with hook 26. In addition, the strap 116 has a notch 116*a* formed in it in order for the hook 26 to engage the notch 116*a* during lifting and lowering.

The strap 16 or 116 can be molded plastic, or it can be a rigid material. Also, strap 16 or 116 can be made of flexible or pliable materials.

OPERATION

In operation, the broom 20 is used to sweep debris into dust pan 12 without the need for the user to bend. Dust pan 12 is provided with an enlarged area 34 in receptacle 14 to store and collect an increased amount of debris in the rear of dust pan 12, all without bending.

The user then uses the hook 26 on broom 20 to engage the lifting strap 16 on the dust pan 12 to lift the dust pan 12 without the need for bending, so that the user empties the debris in dust pan 12 into a suitable debris collector.

Figure 3:
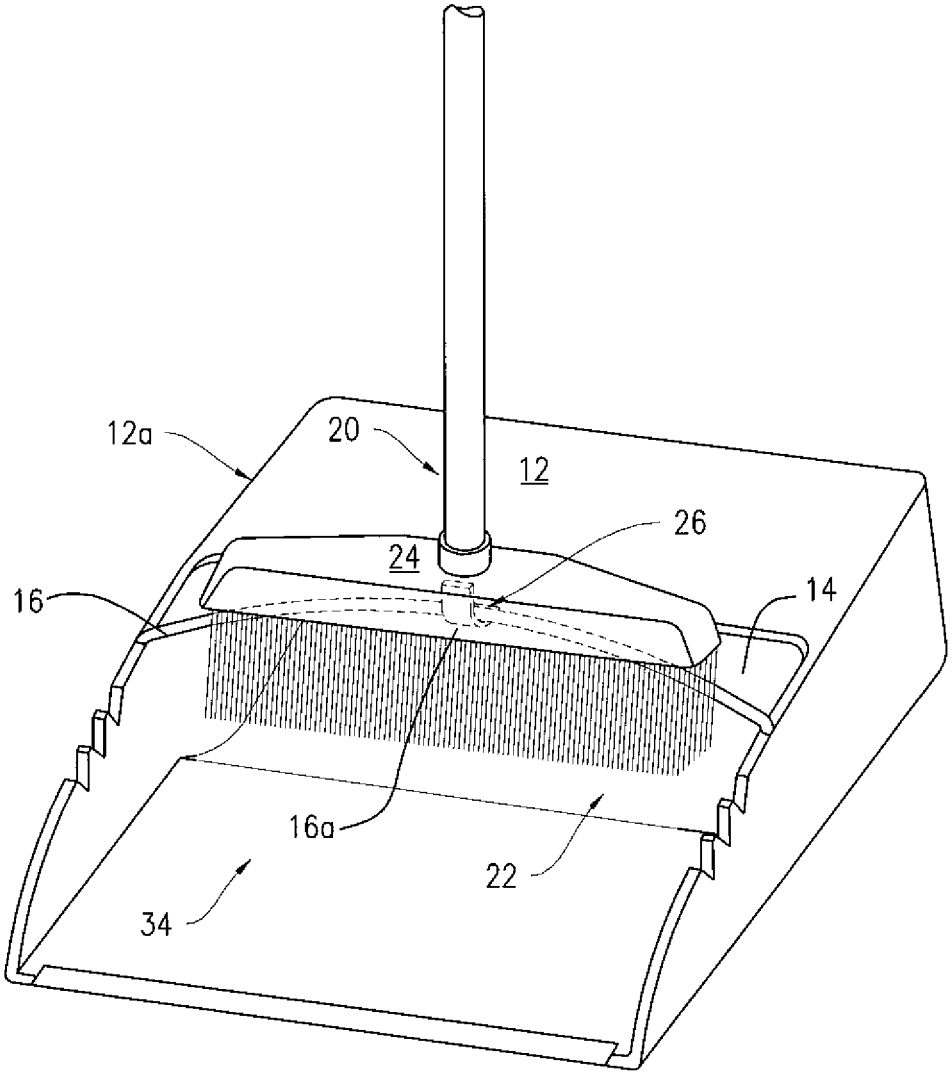
FIG. 3 is a detailed view of the broom.
Figure 4A:
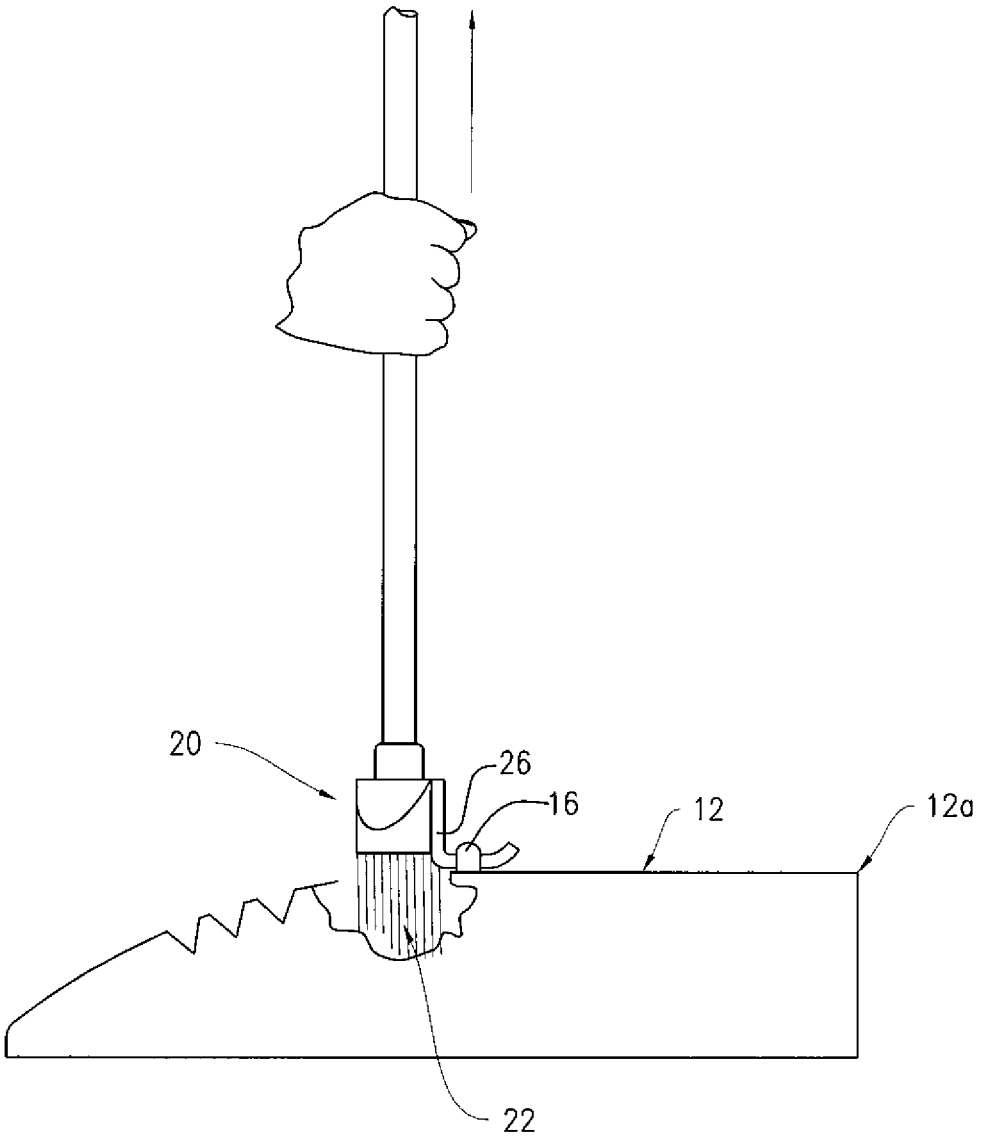
FIG. 4*a* is a detailed view of the hook on the broom.
Figure 4B:
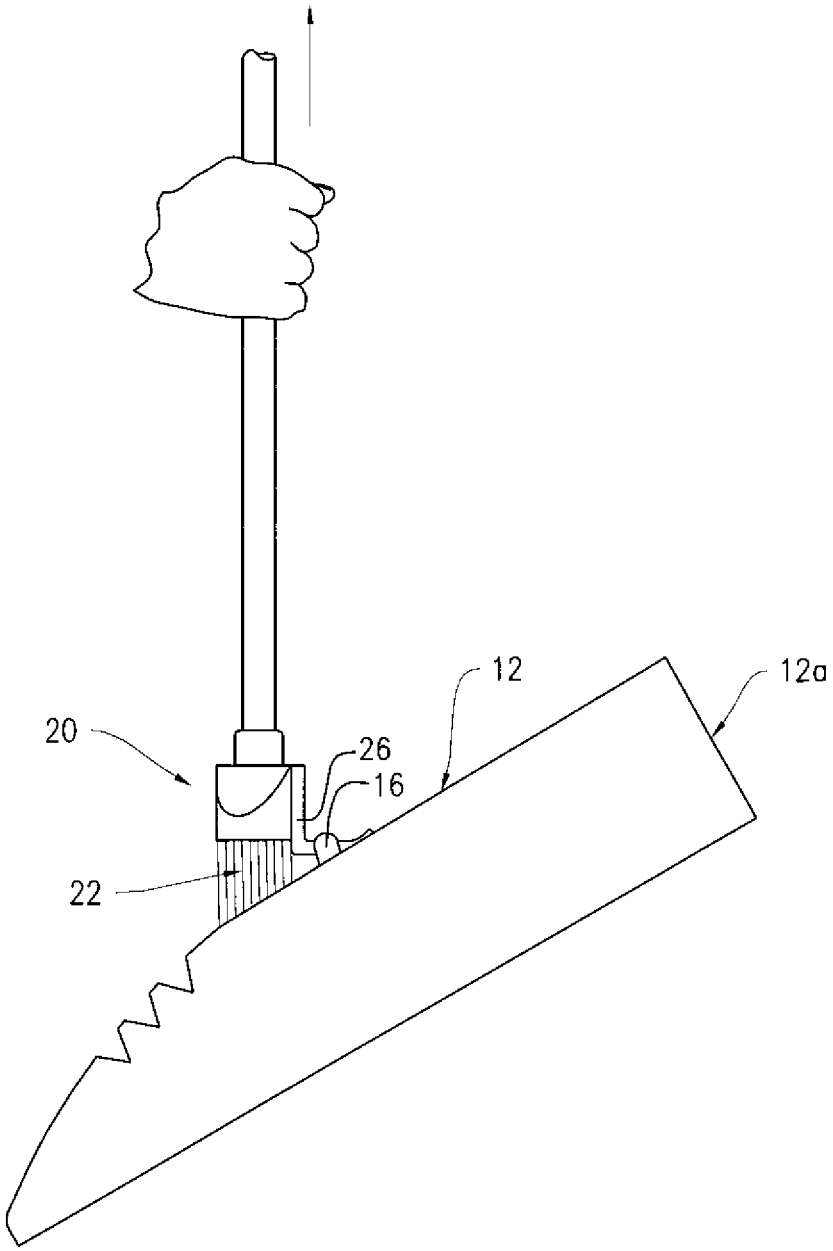
FIG. 4*b* is a view of the dust pan being lifted using the hook on the broom.

In the first embodiment, the dust pan 12 has a rectangular shape and the hook 26 is used to engage the notch 16*a* (shown in FIGS. 1 and 3) on strap 16. In the second embodiment, round dust pan 112 operates in the same manner as dust pan 12, and hook 26 is used to engage the notch 116*a* (shown in FIG. 5) on strap 116.

In this manner, all operations, including sweeping, collecting the debris, and disposing of the debris are all conducted without the user having to bend their knees or back at any point during the operation.

ADVANTAGES OF THE PRESENT INVENTION

It is an advantage of the present invention to provide a dust pan and a broom for cleaning surfaces without the need for the person to bend their back to pick up the dust pan.

Another advantage of the present invention is to provide a construction that prevents the person from having to bend their back to lift up the dust pan.

Another advantage of the present invention is to provide a combination dust pan and a broom that is simple and easy to use.

Another advantage of the present invention is to provide a combination dust pan and a broom that is economical.

A latitude of modification, change and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A combination of a dust pan and a broom for cleaning surfaces without the need for a user to bend during use, comprising:

a) said dust pan having
   i) a receptacle for receiving and collecting debris,
   ii) an upper surface,
   iii) a lifting strap extending over said receptacle,
   iv) a bottom surface,
   v) a front surface, and
   vi) a back surface;

b) wherein said upper surface of said dust pan allows said user to place their foot on top of said dust pan to hold it down during use, and an upperedge has teeth for cleaning the bristles of the broom;

c) wherein said bottom surface of said dust pan has an anti-slip gripping material applied to it to provide an anti-slip bottom surface in order to keep the dust pan in place on all types of surfaces;

d) wherein said broom having bristles, and an upper section of said broom having a hook mounted thereon so that it is open upwardly; and e) wherein said hook is used to engage a notch on said lifting strap in order to lift or lower said dust pan having debris without said user having to bend their back or knees.

2. The combination of a dust pan and a broom in accordance with claim 1, wherein said dust pan has a rectangular shape.

3. The combination of a dust pan and a broom in accordance with claim 1, wherein said lifting strap can be made of molded plastic material, rigid material, flexible material or pliable material.

4. The combination of a dust pan and a broom in accordance with claim 1, wherein said anti-slip bottom surface of said dust pan can be used without said user needing to step on said dust pan to hold it down during use.

5. The combination of a dust pan and a broom in accordance with claim 1, wherein said dust pan has a circular shape.

6. The combination of a dust pan and a broom in accordance with claim 5, wherein said upper surface of said circular shaped dust pan is a cover.

7. The combination of a dust pan and a broom in accordance with claim 5, wherein said circular shaped dust pan is open in said front surface and said back surface.

8. The combination of a dust pan and a broom in accordance with claim 5, wherein said bottom surface of said circular shaped dust pan has a depression.

* * * * *